US008728293B2

(12) United States Patent
Perkins et al.

(10) Patent No.: US 8,728,293 B2
(45) Date of Patent: May 20, 2014

(54) PREPARING ELECTRODES FOR ELECTROPLATING

(71) Applicant: The United States of America as represented by the Secretary of the Navy, Washington, DC (US)

(72) Inventors: F. Keith Perkins, Alexandria, VA (US); Perry Skeath, Tucson, AZ (US); Lee James Johnson, Washington, DC (US); John R Peele, Alexandria, VA (US); William Bassett, Patuxent River, MD (US)

(73) Assignee: The United States of America, as represented by the Secretary of the Navy, Naval Research Laboratory, Washington, DC (US)

( * ) Notice: Subject to any disclaimer, the term of this patent is extended or adjusted under 35 U.S.C. 154(b) by 0 days.

(21) Appl. No.: 13/763,017

(22) Filed: Feb. 8, 2013

(65) Prior Publication Data

US 2013/0146467 A1 Jun. 13, 2013

Related U.S. Application Data

(62) Division of application No. 12/476,522, filed on Jun. 2, 2009, now Pat. No. 8,404,095.

(51) Int. Cl.
*C25D 5/00* (2006.01)
*C25D 5/54* (2006.01)

(52) U.S. Cl.
USPC ..... 205/88; 5/162; 5/211

(58) Field of Classification Search
USPC ..... 205/88, 162, 211
See application file for complete search history.

(56) References Cited

U.S. PATENT DOCUMENTS 5,368,634 A * 11/1994 Hackett ..... 95/260
6,185,961 B1 * 2/2001 Tonucci et al. ..... 65/60.4
2003/0196901 A1 * 10/2003 Grunes ..... 205/88

OTHER PUBLICATIONS

Skeath et al., "Electroformed Microelectrode Array for a Human Retinal Prosthesis Interface" available online at http://www.electrochem.org/ dl/ma/206/pdfs /2576.pdf (no date).*
Panescu, "MEMS in Medicine and Biology" in IEEE Eng. Med. Biol. Mag., pp. 19-28 (Sep./Oct. 2006).*

* cited by examiner

*Primary Examiner* — Bryan D. Ripa
(74) *Attorney, Agent, or Firm* — US Naval Research Laboratory; Stephen T. Hunnius

(57) ABSTRACT

A method of immersing an electrode in an electroplating solution while under vacuum, to substantially eliminate air and/or other gas from microscopic holes, cavities or indentations in the electrode. A method of electroplating an electrode in an electroplating solution including the application of a vacuum to the electrode while it is immersed in the electroplating solution to thereby substantially eliminate air and/or other gas from microscopic holes, cavities or indentations in the electrode. The electroplating liquid may be applied to only one side of the electrode ("the wet side") in which case, sufficient time is allowed to pass for the immersion liquid to fill the microscopic through-holes, cavities or indentations in the electrode. An enhancement of this mode is to force liquid through the microscopic holes from the wet side. A highly penetrating solvent may be used as an immersion liquid. Alternatively, carbon dioxide can be used as an immersion liquid, in which case the liquid carbon dioxide may be obtained by adjusting the temperature and pressure conditions in a closed container of gaseous carbon dioxide.

18 Claims, 4 Drawing Sheets

PREPARING ELECTRODES FOR ELECTROPLATING

This application claims priority to and the benefits of U.S. patent application Ser. No. 12/476,522 filed on Jun. 2, 2009 the entirety of which is herein incorporated by reference.

BACKGROUND OF THE INVENTION

1. Field of the Invention

The present invention relates to electroplating of electrodes. In particular the invention relates to processes for preparing electrodes for electroplating as well as processes of electroplating of electrodes.

2. Description of the Related Technology

Microscopic holes, cavities or indentations in a working electrode can trap air when the working electrode is immersed in electroplating solution for electroplating. The trapped air may impede or prevent desired metal deposition in the microscopic holes of the working electrode. For example, bubbles can cause pinholes in the plated metal layer. The problem is especially troublesome when the working electrode is designed to have millions of deep microscopic holes, and it is desired to completely fill every one of these microscopic holes with electroplated metal. This problem is encountered, for example, when making microwire glass for electronic devices that utilize microelectrode arrays from a glass microchannel plate.

A glass microchannel plate (MCP) is shown in FIG. 1. The MCP 11 consists of a glass plate 11 with a high density of open, microscopic channels 12 that extend through the plate 11 from one side to the other. The empty microchannels 12 are typically uniform in size, extremely straight and parallel to each other, and arranged in an orderly array. A MCP 11 with a microchannel diameter of 5 micrometers typically has approximately 1.8 million separate microchannels 12 per square centimeter.

Commercially available microchannel plates 11 (e.g., from Collimated Holes, Inc.) with 5 micrometer diameter microchannels 12 can be 500 to 1,000 micrometers thick. When the microchannel plate 11 is immersed in an electroplating bath, a bubble in any microchannel 12 can partially or fully block the deposition of metal via electroplating in that microchannel 12. Because of both the very high aspect ratio (the ratio of microchannel length to diameter can be as high as 200:1) and the huge number of microchannels 12 in a square centimeter of a MCP 11, there is a high propensity for trapped air to form bubbles in some of the microchannels 12 when the MCP 11 is immersed in a liquid such as an electroplating bath.

In theory, the force of capillary draw should be sufficient to force the electroplating liquid to fill the microchannels 12, but in practice this does not happen in all of the microchannels 12. Incomplete deposition of metal in the microchannels 12 can compromise the integrity and performance of any device which incorporates "microwire glass" (MWG). MWG is a glass microchannel plate 11 that has the microchannels 12 filled with metal to form an array of microwires.

To make microwire glass (MWG), a microchannel plate 11 is mounted in such a way that metal electroplating will start from one end of the microchannels 12 (the "start-side" of the MCP 11) and proceed to fill the microchannels 12 with metal all the way through to the opposite end of the microchannels 12 (the "finish-side"). The MCP 11 is typically sealed in a mount such that the only pathway for metal deposition by electroplating is through the microchannels 12. A bubble anywhere inside the length of any microchannel 12 can impede or block electrodeposition in that microchannel 12.

Accordingly, there is a need in the art to provide an improved process for electroplating of microchannels to reduce or eliminate defects which may be caused by gas bubbles present during the electroplating process.

This and other objects of the present invention will be apparent from the summary and detailed description which follow.

SUMMARY OF THE INVENTION

In a first aspect, the invention relates to a method of immersing an electrode in an electroplating solution while under vacuum, to substantially eliminate air and/or other gas from microscopic holes, cavities or indentations in the electrode.

In a second aspect, the invention relates to a method of electroplating an electrode in an electroplating solution including the application of a vacuum to the electrode while it is immersed in the electroplating solution to thereby substantially eliminate air and/or other gas from microscopic holes, cavities or indentations in the electrode.

In a third aspect, the invention relates to a method of electroplating an electrode wherein the electroplating liquid is applied to only to one side of the electrode ("the wet side"). Sufficient time is allowed to pass for the immersion liquid to fill the microscopic through-holes, cavities or indentations in the electrode. An enhancement of this mode is to force liquid through the microscopic holes from the wet side.

In a fourth aspect, the invention relates to a method for preparing an electrode for electroplating by immersing the electrode in a highly penetrating solvent as an immersion liquid, then rinsing and transferring the wetted electrode to a plating bath.

In a fifth aspect, the invention relates to a method for preparing an electrode for electroplating by placing the electrode in a chamber, replacing the air and/or other gas in the chamber with gaseous carbon dioxide, increasing the pressure and/or temperature to the critical point domain of the gaseous carbon dioxide, adjusting the pressure and/or temperature to go from the critical point of the carbon dioxide to a state of full immersion of the electrode in liquid carbon dioxide, displacing the liquid carbon dioxide in the chamber with a plating solution or other liquid, and transferring the wetted electrode to a plating bath.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
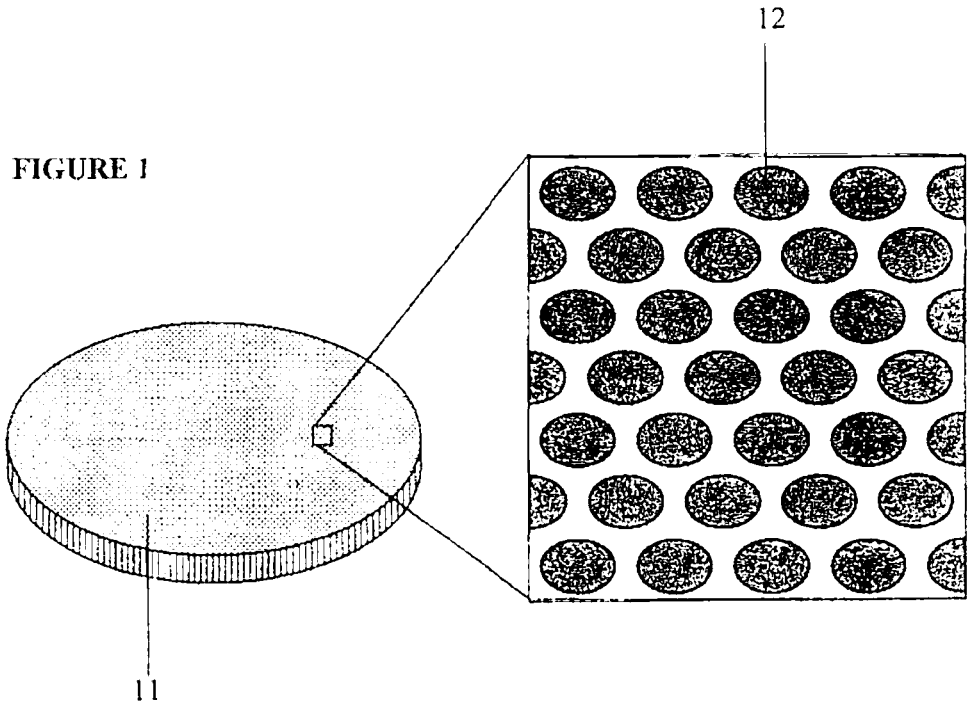
FIG. 1 shows a glass microchannel plate (MCP) having empty microchannels extending through the entire thickness of the plate. The inset of FIG. 1 shows a microscopic view of the designated portion of the hexagonal array of round, empty microchannels of the MCP.

A dry electrode or working electrode may be immersed directly into a plating bath, or it may first be immersed in some other liquid and then transferred while still wet into the plating bath. As used herein, "immersion liquid" refers to the liquid in which a dry working electrode is first wetted or immersed.

The first aspect of the invention, referred to herein as, "the bubble prevention mode" is the preferred mode of the invention. This aspect of the invention substantially or completely eliminates air or other gas from the microscopic holes, cavities or indentations in the electrode before immersion of the electrode in liquid, thereby preventing the formation of gas bubbles in the microscopic holes, cavities or indentations in the electrode which may impair the subsequent electroplating process.

The bubble prevention mode involves preparing the microscopic holes, cavities or indentations of the electrode for electroplating by removing substantially or completely all air and/or other gases therefrom. In the first step of the method, one or more dry working electrode(s) are placed in a vacuum chamber with an immersion liquid. Preferably, the dry working electrode piece and the liquid container are positioned such that (a) droplets from boiling immersion liquid will not land on the working electrode surface, and (b) the working electrode piece can be immersed in the plating solution while under vacuum. The vacuum chamber is closed and the air and/or gas are removed from the chamber. Preferably, sufficient time under vacuum is allowed for the vapor which is continually generated by the boiling immersion liquid (e.g., water vapor from an aqueous plating solution) to sweep other gases out of the vacuum chamber. Evacuation of the chamber may be done under conditions which cause boiling of the immersion liquid.

The immersion liquid may then be allowed to degas in order to allow gases dissolved in the immersion liquid to escape from the vacuum chamber. This permits the air and/or gases to be thoroughly evacuated from the microscopic holes in the working electrode piece.

While maintaining vacuum conditions in the chamber, the working electrode piece(s) is fully submerged in the immersion liquid. While maintaining immersion of the working electrode piece(s) in the immersion liquid, the pressure in the chamber is raised to atmospheric pressure (one atmosphere) to thereby force liquid into parts of microchannels 12 that have not already been filled with immersion liquid. Thus, if there remains a small amount of trapped gas in some of the microchannels 12, after evacuation of the chamber and immersion of the working electrode piece(s) in the liquid, this trapped gas can be dissolved into the degassed liquid that has already entered the microchannels. As a variation of the invention, the pressure may be raised to above atmospheric pressure, i.e. above one atmosphere, if desired, though the pressure should not be so high as to damage the electrode.

No part of the working electrode piece(s) surface having microscopic holes that are to be plated should be allowed to become dry during the method, even momentarily, until after all of the microscopic holes have been filled with plated metal to the desired degree. Thus, in one embodiment, the working electrode piece(s) is maintained submerged in the immersion liquid until it was time to transfer it to the plating bath. At that time, the working electrode piece(s) can be quickly transferred into the plating bath to maintain wetting on the surfaces of the piece(s). Following the transfer into the plating bath, the microchannels 12 may be completely filled with plated metal by electroplating.

When the working electrode is carefully placed in a liquid, trapping of air in microscopic holes, cavities or indentations involves two distinct mechanisms' (1) presence of air in the microscopic holes, cavities or indentations, and (2) surface tension effects which impede the flow of liquid throughout the microscopic holes, cavities or indentations. The preferred mode of the invention overcomes both of these mechanisms which cause air to be trapped. Specifically, the preferred mode of the invention: (a) reduces the amount of air in the microscopic holes, cavities or indentations before immersion in the immersion liquid by many orders of magnitude in a vacuum chamber, (b) displaces any remaining air in the microscopic holes, cavities or indentations with water vapor (which immediately condenses to liquid once external air pressure is restored), and (c) degasses the liquid before it enters the microscopic holes, cavities or indentations, so that any tiny amount of air remaining in the microscopic holes, cavities or indentations can be quickly dissolved into the liquid.

In terms of the air-trapping mechanism (2), namely, surface tension effects, the preferred mode of the invention overcomes surface tension effects by creating a near-zero pressure environment inside the microscopic holes, cavities or indentations. Then atmospheric pressure or a pressure greater than atmospheric pressure is applied from outside the microscopic holes, cavities or indentations, providing a force which can overcome surface tension effects that impede the movement of liquid into the microscopic holes, cavities or indentations.

Figure 2A:
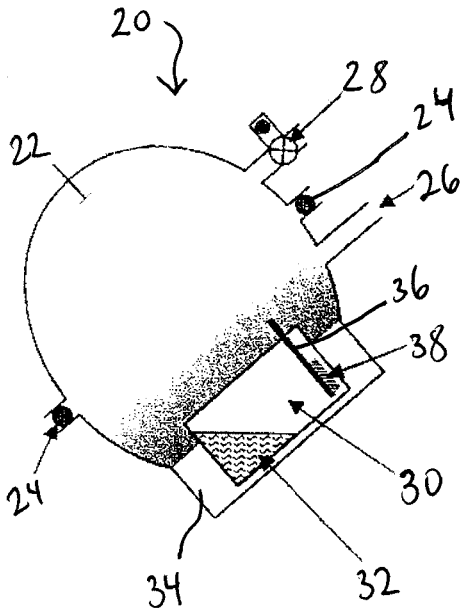
FIG. 2*a* shows an apparatus for carrying out the method of the present invention in a position suitable for evacuation of the chamber of air and/or gases.
Figure 2B:
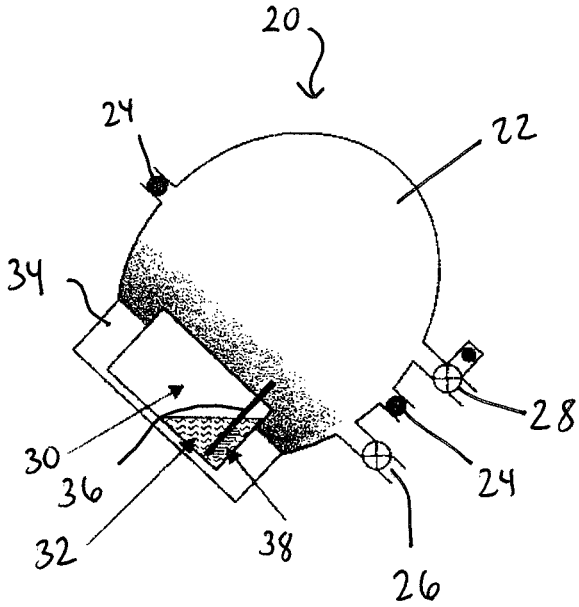
FIG. 2*b* shows the apparatus of FIG. 2*a* with the working electrode piece immersed in an immersion liquid.

An apparatus 20 for carrying out the invention is shown in FIGS. 2*a*-2*b*. In FIG. 2*a* the apparatus 20 is shown in a position suitable for evacuation of the chamber of air and/or gases. The apparatus includes a vacuum dessicator 22 provided with vacuum seals 24 and a pump port 26 to which a suitable vacuum pump, not shown, may be attached. In FIG. 2*a*, pump port 26 is shown in the open position to reflect the fact that the vacuum dessicator 22 is being evacuated when apparatus 20 is in the position shown in FIG. 2*a*. Vacuum dessicator 22 is also provided with a vent valve 28 which can be used to vent the vacuum dessicator 22 to atmosphere.

The apparatus 20 of FIG. 2*a* is provided with plating liquid 32 located in a glass vessel 30 which is attached to vacuum dessicator 22. Glass vessel 30 and vacuum dessicator 22 may be mounted in any suitable housing or frame 34 to facilitate tilting of the apparatus 20 between the positions shown in FIGS. 2*a*-2*b*. Glass vessel 30 is provided with a mount 36 for mounting working electrode piece 38 thereon.

As shown in FIG. 2*a*, working electrode piece 38 is mounted on mount 36 at a sufficient distance above plating liquid 32 to avoid spattering of plating liquid 32 onto working electrode piece 38 as a result of boiling of plating liquid 32 during evacuation of apparatus 20. Once evacuation is complete and sufficient time has been allowed to pass to degas the plating liquid 32, apparatus 20 is tilted to the position shown in FIG. 2*b* to immerse the working electrode piece 38 in the plating liquid 32. After a suitable immersion time, vent valve 38 is opened to raise the pressure in apparatus 20 to atmospheric pressure.

In a second aspect, the present invention relates to a, "bubble removal mode" wherein the working electrode piece is submerged in the immersion liquid which allows air to be trapped in microscopic holes, cavities or indentations and then a vacuum is applied while the working electrode piece is maintained in the immersion liquid. A substantial amount of air can be quickly drawn out from microscopic holes, cavities or indentations by the vacuum. However, shortly after vacuum is applied some trapped air will typically remain in microscopic holes, cavities or indentations due to a combination of surface tension effects and the solid walls of the microscopic holes, cavities or indentations.

For example: due to the high curvature of a microscopic bubble (which can be supported and stabilized by the solid walls of microscopic holes, cavities or indentations), surface tension can enable pressure inside the bubble to be maintained at a level that is many orders of magnitude higher than the applied vacuum. In such a situation, the trapped bubble may not expand even though its internal pressure is many orders of magnitude higher than the applied vacuum. Also, if a trapped bubble expands then most but not all of the trapped air may move outside of the microscopic holes, cavities or indentations. The expanded bubble may not be dislodged while in the vacuum. When atmospheric pressure is restored then the bubble simply collapses back into the microscopic hole, cavity or indentation where it was originally trapped. Vibration of the entire apparatus of FIG. 2 or the glass vessel 30 can facilitate the dislodging of the bubbles. For these reasons it is a condition of this second aspect of the invention that the applied vacuum must be maintained for a length of time that is sufficient for gas trapped in microscopic bubbles to dissolve into the immersion liquid.

In a more preferred version of this second aspect of the invention, steps are taken to facilitate diffusion of the dissolved through the liquid from the bubble to the liquid-vacuum interface, and vaporize the dissolved gas from the liquid at the liquid-vacuum interface so that it may be removed from the system by the vacuum pump.

This bubble removal mode of the invention is most effectively utilized by selecting a gaseous environment and an immersion liquid such that the gas very readily dissolves into, diffuses through, and vaporizes from the immersion liquid. Water, wetting agents or platting solutions are preferred immersion liquids. Gases with high water solubility such as $CO_2$, $H_2S$ and $C_2H_2$ may be used for preferred gaseous environments.

In a third aspect, the present invention can be carried out in the, "flow-through mode." In the flow-through mode, immersion liquid is first applied to only one side of the working electrode which then becomes the wet side. Sufficient time is then allowed for the immersion liquid to fill the microscopic through-holes. Typical times are between 1 and 20 minutes, but can vary depending on microchannel size. In this way air is not trapped in the middle of the through-holes as liquid enters from both ends of a microscopic hole, cavity or indentation as would be the case if the working electrode piece were merely immersed in the immersion liquid. An enhancement of the flow-through mode is to force liquid through the microscopic holes from the wet side by application of pressure to the wet side or vacuum to the dry side of the working electrode piece.

In a fourth aspect, the invention encompasses the so-called, "penetrating solvent mode." In the penetrating solvent mode, a highly penetrating solvent is employed as the immersion liquid. Then, without allowing any surface drying of the working electrode, the working electrode piece is rinsed and transferred into the plating bath. A highly penetrating solvent should have a lower surface tension than water. This improves wetting. However, the highly penetrating solvent should not leave a residue that will be detrimental to electroplating and the solvent should interact well with water. An example of a suitable highly penetrating solvent is methanol.

In a fifth aspect, the present invention relates to the "critical point wetting mode." This mode of the invention is the reverse of the critical-point drying method used to avoid stiction in MEMS. In the critical-point wetting mode of the invention, the working electrode is placed in a chamber and the air in the chamber is replaced with gaseous carbon dioxide. The carbon dioxide pressure and/or the temperature in the chamber are increased, until the carbon dioxide critical-point domain is achieved. At that point, the carbon dioxide pressure and/or temperature are adjusted to go from the critical point domain to full immersion of the working electrode piece in liquid carbon dioxide. Liquid carbon dioxide within the chamber is displaced by flowing plating solution or another liquid (such as methanol or deionized water) through the chamber and the pressure and temperature in the chamber are reduced to normal room temperature and pressure, e.g. 1 atmosphere and 20 degrees Celsius. Finally, the working electrode piece is removed from the chamber and transferred to the plating bath without allowing the working electrode surface to dry.

Each of the various aspects of the invention may be applied individually or in combination with any other aspects of the invention to the extent possible. Thus, for example, each aspect of the invention can be carried out using an immersion liquid which is a penetrating solvent. Also, the flow-through mode can be combined with any of the other modes of the invention using the flow-through mode as the initial step of wetting the working electrode piece with immersion liquid.

The following additional conventional practices for wetting surfaces may be applied individually or in combination to enhance each of the above-described modes of the invention or combinations of the above-described modes of the invention.

A small amount of surfactant may be added to the immersion liquid and/or plating solution to reduce the liquid's surface tension and improve wetting action. It is particularly helpful to use a surfactant (such as 3M Company's L-18691 or L-19023 surfactants) that tend not to degrade over time in the plating solution, so that any bubbles which form during the course of electroplating may be dislodged from the working electrode more easily.

The surface of the working electrode may be treated in oxygen plasma or with an adhesion promoter such as hexamethyldisilazane vapor, to alter the working electrode's surface energy and improve wetting action. Such a treatment may be used in conjunction with any of the embodiments of the invention described above.

For some applications involving microwire glass (MWG), 99.9% filling of a microchannel plate (MCP) is not good enough—100% filling is required. For this situation or any MWG requiring 100% filling of the MCP, the few remaining holes of the MWG can be filled with epoxy ("Post-Plating Epoxy Fill"). Post-Plating Epoxy Fill utilizes vacuum to greatly improve filling holes, including blind holes, with epoxy, in much the same way that the Bubble Prevention mode of the invention used vacuum to greatly improve filling with plating solution.

The first step toward Post-Plating Epoxy Fill involves removing excess plated metal from the working electrode (e.g., grinding), and thoroughly cleaning the working electrode to remove all plating or cleaning solution, cleaning abrasives, etc so that any remaining microscopic holes, cavities or indentations are fully open for filling. In the case of microwire glass, an occasional microchannel may not plate all the way through the microchannel plate and a very small number of microchannels may not plate at all. As a result, the "finish side" (i.e. the side of the microchannel plate where the last metal is plated) of the MWG has more holes than the "start side" (i.e. the side where the first metal is plated), Therefore the Post-Plating Epoxy Fill is performed on the finish side of the MWG—preferably, immediately after excess metal is removed by grinding. The Post-Plating Epoxy Fill can be performed in the same apparatus as the grinding by performing the Post-Plating Epoxy Fill before de-mounting the MWG from the glass plate used to hold it during grinding.

In the first step of the Post-Plating Epoxy Fill, the dry working electrode piece(s) and an open container of mixed epoxy are loaded into a vacuum chamber. The dry working electrode piece and the open liquid container are positioned such that (a) droplets from boiling epoxy will not land on the working electrode surface, and (b) the working electrode piece can be immersed in the epoxy while under vacuum.

The type of epoxy is chosen based on the application. Epotek™ type 377 and 353 ND epoxies are one suitable type of epoxy which may be used for the Post-Plating Epoxy Fill due to their hardness, mechanical strength and tolerance to high temperatures. Epotek™ type 301-2FL may be used when low fluorescence is desired. Other filler materials could also be used in place of, or in addition to, epoxy materials. Other suitable materials may include, for example, waxes, glasses or similar filler materials.

Air and/or gases are then pumped out of the vacuum chamber. Sufficient time should then be allowed under vacuum for vapor released by the epoxy to sweep other gases out of the vacuum chamber, the epoxy to degas to remove air and water dissolved in the epoxy, and for the air to be thoroughly evacuated from the microscopic holes in the working electrode piece.

While maintaining vacuum conditions in the chamber, the working electrode piece(s) are then fully submerged in the epoxy. This may be accomplished by stopping the evacuation of the chamber, waiting a few seconds for the bubbling of the epoxy to reduce, and then immersing the working electrode piece in the epoxy.

While maintaining the working electrode piece immersed in the epoxy, the chamber pressure is then raised to atmospheric pressure. Raising the pressure while maintaining immersion of the working electrode piece in the epoxy forces epoxy into any parts of microchannels that are not already filled. If there remains any tiny amount of trapped air in some of the microchannels, it may be dissolved into the degassed epoxy that has entered the microchannels. As a variation of the Post-Plating Epoxy Fill, the pressure may be raised above atmospheric pressure.

Excess epoxy may then be removed from the working electrode (e.g. by wiping very gently), but not so much that epoxy is removed from the working electrode's microscopic holes. Finally, the epoxy may be cured in the working electrode.

Figure 4A:
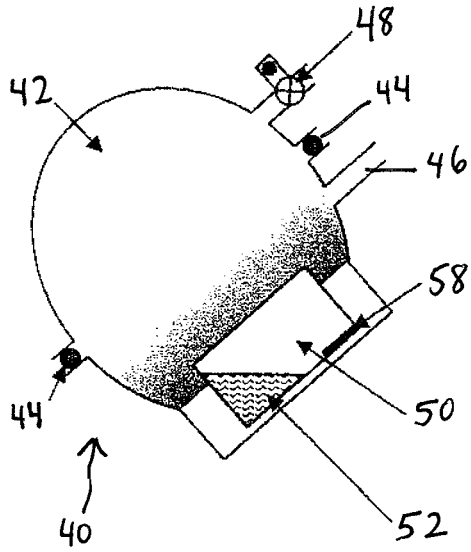
FIG. 4*a* shows an apparatus for carrying out the Post-Plating Epoxy Fill of the present invention in a position suitable for evacuation of the chamber of air and/or gases.
Figure 4B:
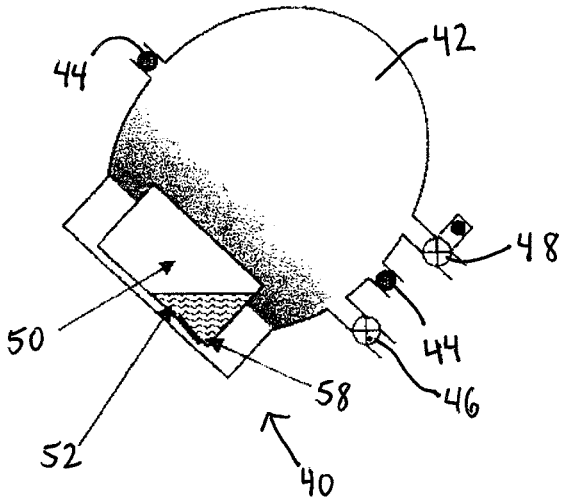
FIG. 4*b* shows the apparatus of FIG. 4*a* with the working electrode piece immersed in the epoxy.

An apparatus 40 for carrying out the Post-Plating Epoxy Fill is shown in FIGS. 4*a*-4*b*. In FIG. 4*a* the apparatus 40 is shown in a position suitable for evacuation of the chamber of air and/or gases. The apparatus includes a vacuum dessicator 42 provided with vacuum seals 44 and a pump port 46 to which a suitable vacuum pump, not shown, may be attached. In FIG. 4*a*, pump port 46 is shown in the open position to reflect the fact that the vacuum dessicator 42 is being evacuated when apparatus 40 is in the position shown in FIG. 4*a*. Vacuum dessicator 42 is also provided with a vent valve 48 which can be used to vent the vacuum dessicator 42 to atmosphere.

The apparatus 40 of FIG. 4*a* is provided with epoxy 52 located in a glass vessel 50 which is attached to vacuum dessicator 42. Glass vessel 50 and vacuum dessicator 42 may be mounted in any suitable housing or frame 54 to facilitate tilting of the apparatus 40 between the positions shown in FIGS. 4*a*-4*b*. Microwire glass 58 is located in the glass vessel 50 at a sufficient distance above epoxy 52 to avoid spattering of epoxy 52 onto microwire glass 58 as a result of boiling of epoxy 52 during evacuation of apparatus 40.

Once evacuation is complete and sufficient time has been allowed to pass to degas the epoxy 52, apparatus 40 is tilted to the position shown in FIG. 4*b* to immerse the microwire glass 58 in the epoxy 52. After a suitable immersion time, vent valve 48 is opened to raise the pressure in apparatus 40 to atmospheric pressure.

The method of the invention provides a reproducible plating process which greatly improves the completeness of coverage of the plating material on the substrate and improves the integrity of the plated metal. The invention is useful for the formation of metal microwires, such as nickel microwires within a glass microchannel plate having over a million 5-micron-diameter microchannels per square centimeter. The invention has reduced the percentage of microchannels that were incompletely filled with nickel by more than an order of magnitude, as compared to the use of a conventional plating process.

EXAMPLES

Example 1

The Bubble Prevention Mode and Comparative Example A

A low-cost plastic vacuum desiccator was used as the vacuum chamber and a Pyrex® glass bowl 150 mm in diameter and 75 mm in height was employed to hold the plating solution. The bowl was partially filled with nickel plating solution to about 20% of capacity, and the whole vacuum desiccator (including the bowl) was tilted so that all of the plating solution was on one side of the bowl (see FIG. 2*a*). A dry working electrode piece (a MCP with 5 micrometer-diameter channels, mounted on a solid nickel metal plate that was larger than the working electrode piece) was fastened to the dry inside wall of the bowl that was highest, oriented such that the dry working electrode piece was shielded from any splattering liquid by the solid nickel metal plate on which it was mounted. The vacuum chamber was closed and the air was pumped out. Sufficient time under vacuum was then allowed for the vapor continually generated by the plating solution (e.g., water vapor from an aqueous plating solution) to sweep other gases out of the vacuum chamber.

The plating solution was allowed to degas so that air dissolved in the plating solution escaped from the vacuum chamber. The air was thoroughly evacuated from the microscopic holes in the working electrode piece. The vacuum desiccator was evacuated using a mechanical pump with sufficient pumping speed such that the room-temperature aqueous plating solution boiled vigorously, and this pumping condition was maintained for five minutes before continuing to the next step.

While maintaining vacuum conditions in the chamber, the working electrode piece(s) was fully submerged in the plating solution This was accomplished by stopping the evacuation of the chamber, waiting only 2-3 seconds for the bubbling of the plating solution to cease, and then gently tilting the whole vacuum desiccator in the opposite direction so that the liquid in the bowl covered the working electrode (see FIG. 2*b*).

While maintaining immersion of the working electrode piece in the liquid, the chamber pressure was raised to atmospheric pressure to force liquid into parts of microchannels that were not already filled. The pressure was raised by opening a vent valve on the desiccator to admit room air into the desiccator.

The working electrode piece was maintained submerged in the liquid until it was quickly transferred into the plating bath. Following the transfer into a nickel plating bath, the microchannels were completely filled with nickel by electroplating.

When a 1" square microchannel plate (1 mm thick, with 5 micrometer-diameter channels) is immersed in a nickel plating solution and electroplated in a comparative example without use of the method of this invention, and then nickel plating is done starting from the start-side all the way through to the finish-side, the percentage of microchannels that are incompletely filled with nickel varies within a range from 3% to 50% of all microchannels.

Figures 3A, 3B:
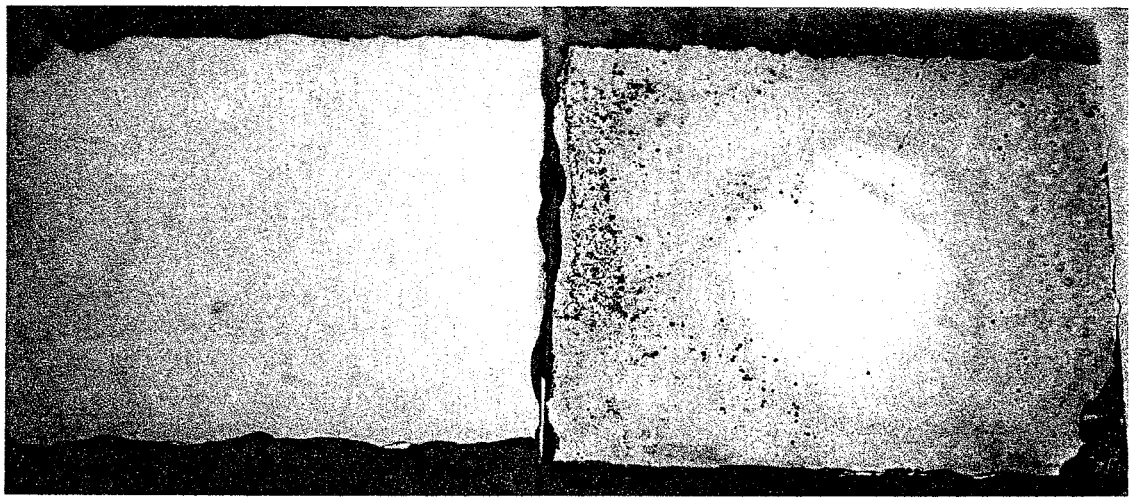
FIG. 3*a* shows the polished finish side of a microwire glass sample prepared by the bubble prevention mode of the present invention which is essentially free of defects.
FIG. 3*b* shows the polished finish side of a microwire glass sample prepared by the bubble removal mode of the present invention. The microwire glass sample has a central region that is relatively free of defects but has some empty channels, indicated by dark spots, in the outer region of the sample.

When the preferred mode of the invention of this Example 1 was used, the percentage of incompletely filled microchannels was significantly less than 0.1%. A photograph of a microwire glass sample prepared by the method of Example 1 is shown in FIG. 3*a*. FIG. 3*a* shows that the sample is essentially free of defects or empty channels, which would be indicated by dark spots on the photograph.

Example 2

Bubble Removal Mode

A second microwire glass sample was prepared using the bubble removal mode of the present invention. A photograph of the polished finish side of the microwire glass sample is shown in FIG. 3*b*. The microwire glass sample has a central region that it relatively free of defects but there are some empty channels, particularly in the outer regions, as indicated by the dark spots in the photograph.

Example 3

Post-Plating Epoxy Fill

In this example, a low-cost plastic vacuum desiccator was used as the vacuum chamber and a shallow plastic box-lid held the epoxy and the MWG. The MWG was secured in one end of the box-lid, and the opposite end of the tilted box-lid was partially filled with epoxy to about 20% of capacity. The whole vacuum desiccator (including the box-lid) was highly tilted so that all of the epoxy was located on one side of the box-lid (see FIG. 4*a*).

The vacuum chamber was then closed and air was pumped out. Sufficient time was allowed under vacuum for vapor released by the epoxy to sweep other gases out of the vacuum chamber, the epoxy to degas to remove air and water dissolved in the epoxy, and for the air to be thoroughly evacuated from the microscopic holes in the working electrode piece. The vacuum desiccator was evacuated using a mechanical pump with sufficient pumping speed such that the room-temperature 3.53ND epoxy bubbled, and this pumping condition was maintained a few minutes before continuing to the next step.

While maintaining vacuum conditions in the chamber, the working electrode piece(s) were fully submerged in the epoxy. This was accomplished by stopping the evacuation of the chamber, waiting only 2-3 seconds for the bubbling of the epoxy to reduce, and then gently tilting the whole vacuum desiccator in the opposite direction so that the epoxy in the box-lid covered the working electrode (see FIG. 4*b*).

While maintaining the working electrode piece immersed in the epoxy, the chamber pressure was raised to atmospheric pressure. Raising the pressure while maintaining immersion of the working electrode piece in the epoxy forces epoxy into any parts of microchannels that are not already filled. If there remains any tiny amount of trapped air in some of the microchannels, it may be dissolved into the degassed epoxy that has entered the microchannels. The pressure was raised by opening a vent valve on the desiccator to admit room air into the desiccator.

Excess epoxy was then removed from the working electrode (e.g. by wiping very gently), but not so much that epoxy is removed from the working electrode's microscopic holes. Finally, the epoxy was cured in the working electrode. In the case of an MWG, the working electrode surface may then be polished.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A method for preparing a microwire glass comprising the steps of:

(a) positioning a working electrode piece in a chamber, (b) evacuating the chamber, (c) immersing the working electrode piece in a plating bath, (d) plating the working electrode to form a microwire glass; and (e) at least partially filling microchannels in said microwire glass with a filler material;

wherein said at least partial filling step comprises the steps of:

(i) positioning the microwire glass in a chamber, (ii) evacuating the chamber, (iii) immersing the microwire glass in a filler material, and (iv) curing the filler material;

wherein prior to said step (c), the working electrode is immersed in an immersion liquid; and wherein said step of immersing said working electrode in the immersion liquid comprises applying said immersion liquid to a side of said working electrode and allowing said immersion liquid to flow through microchannels in said working electrode.

2. The method for preparing the microwire glass of claim 1, further comprising the step of raising the pressure in the chamber to at or above one atmosphere while said working electrode is immersed in the immersion liquid.

3. The method as claimed in claim 1, wherein said working electrode is immersed in an immersion liquid prior to said step (b) of evacuating the chamber.

4. The method as claimed in claim 1, wherein said plating bath is located in the chamber prior to said step (b).

5. The method as claimed in claim 1, wherein said step (b) comprises the step of maintaining a vacuum in the chamber for a sufficient time to degas the plating bath prior to said step (c).

6. The method as claimed in claim 1, wherein said immersion liquid comprises a surfactant.

7. The method as claimed in claim 1, wherein said plating bath comprises a surfactant.

8. The method as claimed in claim 1, wherein a surface of the working electrode is pre-treated with oxygen plasma prior to said step (b).

9. The method as claimed in claim 1, wherein a surface of the working electrode is pre-treated with an adhesion promoter prior to said step (b).

10. The method for preparing the microwire glass of claim 1, wherein said immersion liquid comprises a penetrating solvent.

11. The method as claimed in claim 10, further comprising the step of raising the pressure in the chamber to at or above one atmosphere while said working electrode is immersed in the immersion liquid.

12. The method as claimed in claim 10, wherein in said immersion step (c), the plating bath is applied to only one side of said working electrode and allowed to flow through the microchannels in said working electrode.

13. A method for preparing a microwire glass comprising the steps of:

(a) positioning a working electrode piece in a chamber, (b) immersing the working electrode piece in an immersion liquid, (c) applying a vacuum to the working electrode piece while maintaining the working electrode piece immersed in the immersion liquid for a sufficient time to ensure that substantially all trapped gas in said working electrode piece is dissolved in the immersion liquid, and (d) plating the working electrode to form a microwire glass; and (e) at least partially filling microchannels in said microwire glass with a filler material;

wherein said at least partial filling step comprises the steps of:

(i) positioning the microwire glass in a chamber, (ii) evacuating the chamber, (iii) immersing the microwire glass in a filler material, and (iv) curing the filler material.

14. The method as claimed in claim 13, further comprising the step of vibrating at least the working electrode piece during at least a portion of the application of the vacuum in step (c).

15. The method as claimed in claim 14, wherein the entire chamber is vibrated during at least a portion of the application of the vacuum in step (c).

16. A method for preparing a microwire glass comprising the steps of:

(a) positioning a working electrode piece in a chamber, (b) filling the chamber with gaseous carbon dioxide, (c) adjusting one or more of temperature and pressure conditions in the chamber to the critical point domain for the carbon dioxide, (d) adjusting one or more of temperature and pressure conditions in the chamber to liquefy said carbon dioxide, (e) immersing the working electrode in the liquid carbon dioxide, (f) displacing the liquid carbon dioxide with a plating solution or other liquid, (g) locating the working electrode in a plating bath, and (h) plating the working electrode to form a microwire glass.

17. The method as claimed in claim 16, wherein prior to step (g), the temperature and pressure conditions in said chamber are further adjusted to about atmospheric temperature and pressure.

18. The method as claimed in claim 17, wherein in step (g), said working electrode is located in the plating bath without allowing said working electrode to become dry after step (f).

* * * * *